US008800666B2

(12) United States Patent
Guesnon

(10) Patent No.: US 8,800,666 B2
(45) Date of Patent: Aug. 12, 2014

(54) METHOD FOR LIGHTENING A RISER PIPE WITH OPTIMIZED WEARING PART

(75) Inventor: Jean Guesnon, Chatou (FR)

(73) Assignee: IFP Energies Nouvelles, Rueil-Malmaison Cedex (FR)

( * ) Notice: Subject to any disclaimer, the term of this patent is extended or adjusted under 35 U.S.C. 154(b) by 45 days.

(21) Appl. No.: 13/126,843

(22) PCT Filed: Sep. 23, 2009

(86) PCT No.: PCT/FR2009/001137
§ 371 (c)(1),
(2), (4) Date: Apr. 29, 2011

(87) PCT Pub. No.: WO2010/049602
PCT Pub. Date: May 6, 2010

(65) Prior Publication Data

US 2011/0209878 A1 Sep. 1, 2011

(30) Foreign Application Priority Data

Oct. 29, 2008 (FR) ..... 08 06016

(51) Int. Cl.
*E21B 7/12* (2006.01)

(52) U.S. Cl.
USPC ..... 166/367; 166/358; 166/359; 166/360

(58) Field of Classification Search
USPC ..... 166/351, 352, 354, 367
See application file for complete search history.

(56) References Cited

U.S. PATENT DOCUMENTS 3,729,756 A * 5/1973 Cook et al. ..... 441/133
3,858,401 A * 1/1975 Watkins ..... 405/224.2
3,952,526 A * 4/1976 Watkins et al. ..... 405/224.2
3,992,889 A * 11/1976 Watkins et al. ..... 405/224.2

(Continued)

FOREIGN PATENT DOCUMENTS

FR 2 432 672 2/1980
FR 2 653 162 A1 4/1991

(Continued)

OTHER PUBLICATIONS

R. W. Schutz et al., Applying Titanium Alloys in Drilling and Offshore Production Systems, JOM, Apr. 2001, pp. 33-35, XP002529858.

(Continued)

*Primary Examiner* — Matthew Buck
*Assistant Examiner* — Aaron Lembo
(74) *Attorney, Agent, or Firm* — Antonelli, Terry, Stout & Kraus, LLP.

(57) ABSTRACT

A riser pipe for drilling an offshore well comprises a main tube extending the well up to a floating support, an auxiliary line being arranged parallel to main tube (4*a*, 4*b*). The auxiliary line comprises tubular sections (7*a*, 7*b*) made of steel and assembled end to end with a sliding fit by means of a tubular end part (25). According to the invention, a material, a titanium alloy for example, having an elastic limit at least 25% higher than that of the steel tubular sections (7*a*, 7*b*), is selected to manufacture said end part (25), and the end part as well as the end of said sections are dimensioned by taking account of the elastic limit of said material so as to reduce the sealing section of the end part.

16 Claims, 3 Drawing Sheets

(56) References Cited

U.S. PATENT DOCUMENTS

| | | | | |
|---|---|---|---|---|
| 4,099,560 | A * | 7/1978 | Fischer et al. | 166/350 |
| 4,176,986 | A * | 12/1979 | Taft et al. | 405/211 |
| 4,182,584 | A * | 1/1980 | Panicker et al. | 405/224.3 |
| 4,188,156 | A * | 2/1980 | Fisher et al. | 405/224.3 |
| 4,299,260 | A * | 11/1981 | Jansen | 141/311 R |
| 4,374,595 | A * | 2/1983 | Watkins | 285/123.2 |
| 4,514,254 | A | 4/1985 | Klepner | |
| 4,616,707 | A * | 10/1986 | Langner | 166/345 |
| 4,636,114 | A * | 1/1987 | Hale | 405/223.1 |
| 4,646,840 | A * | 3/1987 | Bartholomew et al. | 166/350 |
| 4,762,180 | A * | 8/1988 | Wybro et al. | 166/350 |
| 5,117,914 | A * | 6/1992 | Blandford | 166/344 |
| 5,660,233 | A * | 8/1997 | Sparks | 166/367 |
| 6,004,074 | A * | 12/1999 | Shanks, II | 405/195.1 |
| 6,155,748 | A * | 12/2000 | Allen et al. | 405/195.1 |
| 6,402,430 | B1 * | 6/2002 | Guesnon | 405/224.2 |
| 6,415,867 | B1 | 7/2002 | Deul et al. | |
| 6,419,277 | B1 * | 7/2002 | Reynolds | 285/123.1 |
| 6,578,637 | B1 * | 6/2003 | Maus et al. | 166/350 |
| 7,008,141 | B2 * | 3/2006 | Fitzgerald et al. | 405/224.2 |
| 7,214,114 | B2 * | 5/2007 | Gibson | 441/133 |
| 2006/0065401 | A1 * | 3/2006 | Allen et al. | 166/345 |
| 2007/0044972 | A1 * | 3/2007 | Roveri et al. | 166/367 |

FOREIGN PATENT DOCUMENTS

| | | | |
|---|---|---|---|
| FR | 2 825 116 | A1 | 11/2002 |
| FR | 2 828 121 | A1 | 2/2003 |
| FR | 2 828 262 | A1 | 2/2003 |
| FR | 2 866 942 | A1 | 9/2005 |
| FR | 2 891 578 | A1 | 4/2007 |

OTHER PUBLICATIONS

Michael E. Montgomery, Choke and Kill Lines—Safety and Downtime, West Engineering Services Inc, Aug. 27, 1998, pp. 1-15, XP002529859.

Douglas B. Johnson et al., Composite Choke and Kill Lines, Offshore Technology Conference, May 6, 2002, pp. 1-7, XP002529860.

Ozden O. Ochoa et al., Offshore composites: Transition barriers to an enabling technology, Composites Science and Technology, Jul. 12, 2005, pp. 2588-2596, XP002529861.

* cited by examiner

METHOD FOR LIGHTENING A RISER PIPE WITH OPTIMIZED WEARING PART

FIELD OF THE INVENTION

The present invention relates to the sphere of offshore oil or gas reservoir drilling and development. It relates to a specific riser architecture.

BACKGROUND OF THE INVENTION

A drilling riser pipe, commonly referred to as riser, consists of a series of tubular elements referred to as joints, assembled by mechanical connectors. The tubular elements generally consist of a main tube at the ends of which connecting parts are welded. The main tube is fitted with auxiliary lines commonly referred to as kill line, choke line, booster line and hydraulic line, which allow fluid circulation between the bottom and the surface. The auxiliary lines are usually arranged around the main tube, hence their designation as peripheral lines. The tubular elements are assembled on the drilling site, from a floating support. The riser goes down through the water depth as the tubular elements are assembled to one another, until it reaches the wellhead located on the sea bottom. Floating elements are arranged along the riser so as to lighten the weight thereof in the water.

The development of offshore reservoirs at very great water depths and/or of high-pressure reservoirs requires using risers whose weight and cost are penalizing.

The present invention aims to modify the connection part, commonly referred to as replaceable stab, of the tubes forming the auxiliary lines so as to reduce the sealing section of the connection part, in order to reduce the stresses applied to the entire riser, and thus to reduce the dimensions of the various elements making up the riser, notably to reduce the thickness of the tubes and the diameter of the floats.

SUMMARY OF THE INVENTION

In general terms, the invention describes a method for lightening the weight of a riser for offshore well drilling. The riser comprises a main tube extending the well up to a floating support, at least one auxiliary line being arranged parallel to the main tube, the auxiliary line comprising tubular steel sections assembled end to end, each one of said sections being connected to the adjacent section by means of an end part, said end part being secured to the end of a section and mounted with a sliding fit in the end of another section, seal means being arranged between the end part and the section at the level of the sliding fit. The method is characterized in that a material having an elastic limit at least 25% higher than the elastic limit of the steel of the tubular sections is selected to manufacture said end part, and in that the end part and the end of said sections are dimensions by taking account of the elastic limit of said material so as to reduce the outer section of the end part at the level of the seal means.

According to the invention, the inside diameter of the end part can be selected smaller than the inside diameter of the tubular sections of the auxiliary line.

Preferably, a material having an elastic limit at least 49% higher than the elastic limit of the steel of the tubular sections can be selected to manufacture said end part.

The invention also describes a riser obtained by implementing the method according to the invention. In the riser according to the invention, said material can consist of a metal alloy comprising at least 80 wt. % titanium, Ti-6-4 or Ti-6-6-2 for example.

Alternatively, said material can consist of steel and at least the inner surface of said end part can be coated with an anti-corrosion protective layer.

In the riser according to the invention, each one of said tubular sections can comprise a metallic tubular body hooped by fiber windings coated with a polymer matrix.

BRIEF DESCRIPTION OF THE FIGURES

Other features and advantages of the invention will be clear from reading the description given hereafter, with reference to the accompanying figures wherein.

DETAILED DESCRIPTION

Figure 1:
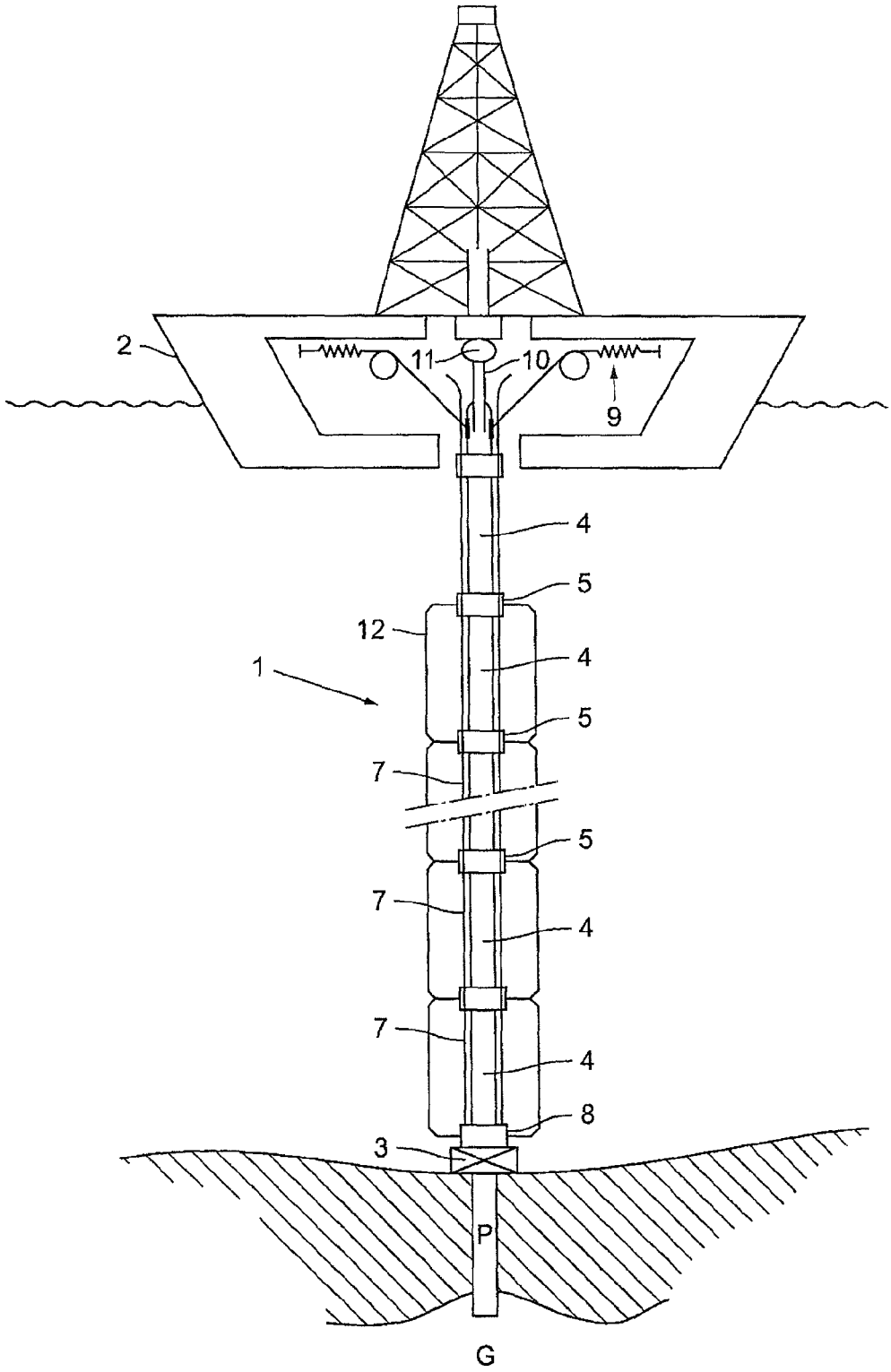
FIG. 1 shows an offshore riser.

FIG. 1 diagrammatically shows an offshore riser 1 for drilling a well P and developing reservoir G. Riser 1 extends well 1 from wellhead 3 to floating support 2, for example a floating platform, a barge or a boat. Wellhead 3 is provided with preventers commonly referred to as "BOPs" or "Blow-Out Preventers".

Figure 2:
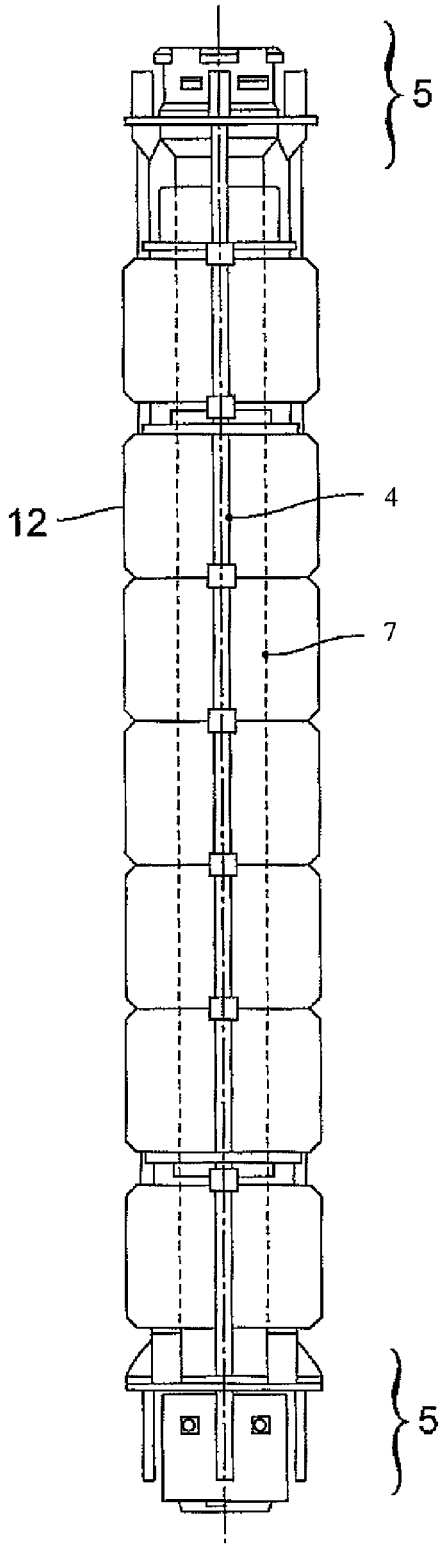
FIG. 2 shows a section of the riser.

Riser 1 is made up of the assembly of several tube sections 4, as shown in detail in FIG. 2, assembled end to end by connectors 5. The connectors can be of bayonet connector type, described for example by documents FR-2,432,672 and FR-2,866,942, or of flange connector type, or of any other connector type.

With reference to FIG. 1, auxiliary lines are arranged parallel to and on the periphery of the main tube made up of the assembly of tubes 4. The auxiliary lines referred to as kill line and choke line are used for circulating fluids between the well and the surface, or vice versa, when the BOPs are closed notably in order to allow control procedures relative to the inflow of fluids under pressure in the well. The auxiliary line referred to as booster line allows mud to be injected at the bottom of the riser. The auxiliary line(s) referred to as hydraulic line(s) allow to transfer a fluid under pressure for controlling the BOPs of the wellhead.

The auxiliary lines consist of several tube sections 7 fastened to the main tube elements and assembled at the level of connectors 5.

Tubes 7 can be mechanically reinforced. Tube elements of optimized resistance by means of a hoop made of a composite material consisting of fibers coated with a polymer matrix are therefore used.

A tube hooping technique consisting in winding under tension composite strips around a metallic tubular body, as described in documents FR-2,828,121, FR-2,828,262 and U.S. Pat. No. 4,514,254, can be used. It is also possible to implement a technique known as self-hooping, which consists in creating the hoop stress during hydraulic testing of the tube at a pressure causing the elastic limit in the metallic body to be exceeded. In other words, strips made of a composite material are wound around the tubular metallic body without inducing significant stresses in the tubular metallic body. Then a predetermined pressure is applied within the metallic body so that it deforms plastically. After return to a zero pressure, residual compressive stresses remain in the metallic body and tensile stresses remain in the composite strips.

In the lower part, riser 1 is connected to wellhead 3 by means of LMRP (or Lower Marine Riser Package) 8. The link between connecting means 8 and the riser can comprise a joint, commonly referred to as ball joint or flex joint, which allows an angular travel of several degrees.

In the upper part, riser 1 is fastened to floating support 2 by a system of tensioners 9 consisting, for example, of an assembly of hydraulic jacks, oleopneumatic accumulators, transfer cables and idler sheaves.

The hydraulic continuity of riser 1 up to the rig floor is provided by a sliding joint 10, commonly referred to as slip joint, and by a joint 11 allowing an angular travel of several degrees.

Floats 12 in form of syntactic foam modules or made of other materials of lower density than the sea water are fastened to main tube 4. Floats 12 allow to lighten riser 1 when it is immersed and to reduce the tension required at the top of the riser by means of the tensioners.

FIG. 2 shows in detail a riser section. Main tube 4 is provided at both ends with the elements of a connector 5 capable of cooperating with one another. Floats 12 are distributed along tube 4. Auxiliary line tube 7 is positioned on the periphery of floats 12. Riser 1 of FIG. 1 consists of an assembly of several sections described with reference to FIG. 2.

Figure 3:
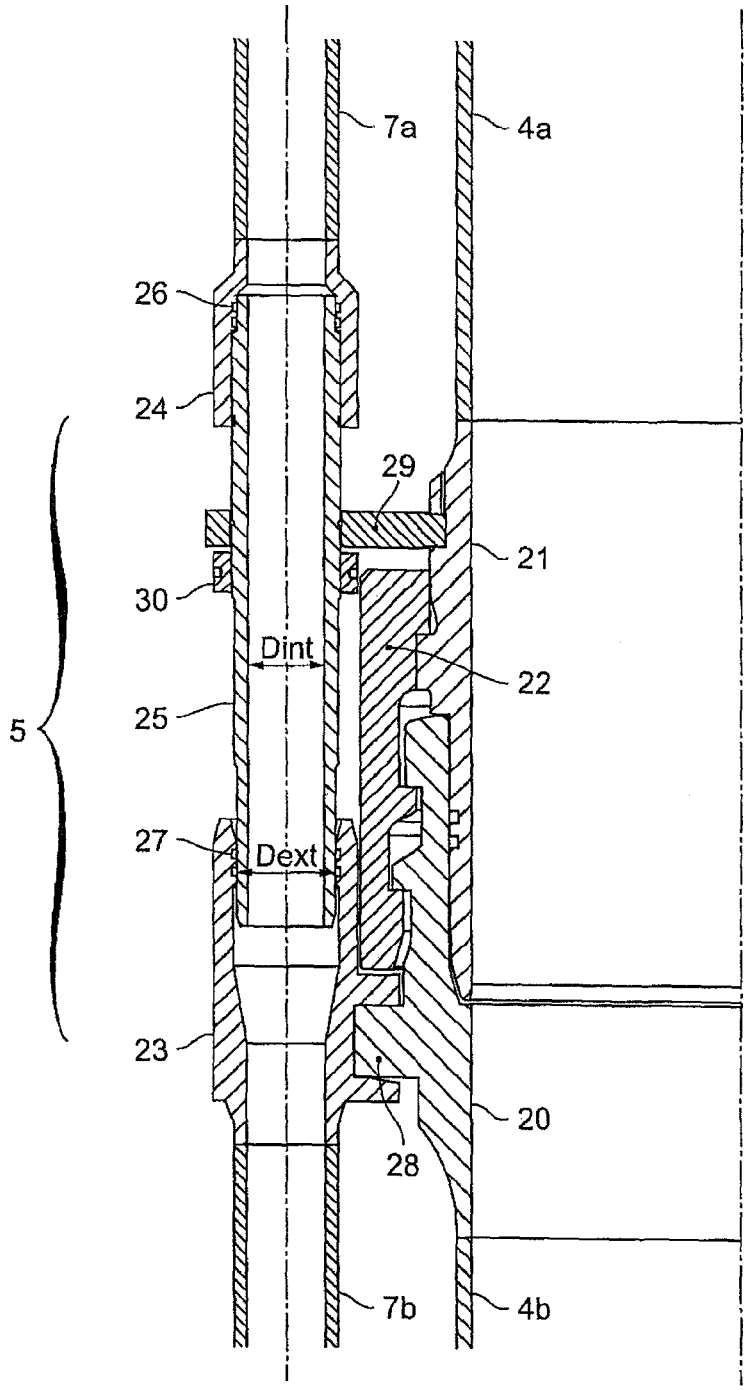
FIG. 3 diagrammatically shows an assembly of auxiliary lines according to the invention.

FIG. 3 shows in detail a connector 5 allowing to assemble two tubes bearing reference number 4, as well as two tubes bearing reference number 7, in FIG. 1. In FIG. 3, the two tubes 4 of FIG. 1 have reference numbers 4*a* and 4*b*, and the two tubes 7 of FIG. 1 have reference numbers 7*a* and 7*b*.

The end of a tube 4*a* is provided with a male tubular part 21 that cooperates with a female tubular part 20 making up the end of adjacent tube 4*b*. A locking ring 22 is mounted on male part 21. Female tubular part 20 comprises tenons (i.e. shoulders extending in the radial direction over a small angular portion) that cooperate with the tenons of locking ring 22 so as to lock the assembly of part 20 with part 21. In general, parts 20 and 21 are welded to the ends of tubes 4*b* and 4*a*.

The ends of tubes 7*a* and 7*b* are respectively provided with female connection means 24 and 23. Parts 23 and 24 are generally welded to the ends of tubes 7*b* and 7*a*. A male end part 25 of tubular shape cooperates with parts 23 and 24 to provide hydraulic continuity of the auxiliary line. For example, end part 25 is screwed inside female connection 24. Joints 26 mounted in grooves provided within female connection 24 provides sealing of the fixed link between end part 25 and connection 24. The inside diameter of connection 23 is slightly greater than the outside diameter of end part 25 so as to allow its fitting and sliding therein. Tube 7*b* is held fixed with respect to tube 4*b* by means of link 28 connecting connection part 23 to connector 5. At the other end, tube 7*a* is simply guided by support plate 29 allowing male end part 25 to slide through an orifice provided in said plate 29.

Thus, when assembling two adjacent elements by means of connector 5 of the main tube, male end part 25 freely enters female end part 23 of the adjacent line and, rubbing against opposite seals 27, automatically provides hydraulic sealing of the link. The sliding movement is so calculated that, even in the worst situation of elongation of the main tube and of shortening of the auxiliary line tube under the effect of stresses, moments, pressures and temperatures, the hydraulic continuity of the link is maintained. On the other hand, if a dysfunction tends to cause decoupling of end part 25 with respect to connection 23, a securing nut 30 screwed onto male end part 25 comes to rest against plate 29 to prevent disconnection.

Male end part 25 is a wearing part, also referred to as replaceable stab, which can be replaced by simple screwing/unscrewing if necessary during the life of the riser.

In general terms, dimensioning of a riser for offshore drilling is notably described in document API RP 2RD (Design of risers for FPs and TLPs) and in document API Spec 16Q.

To dimension a riser, it can be shown that the tension referred to as "effective" tension N(z) at depth point z is equal to tension $T_{top}$ applied by the tensioners at the top of the riser decreased by the weight of the column in the water and by all it contains between the top and the depth point z considered. If one considers that the riser is full of drilling mud and that it is immersed in sea water, one obtains tension N(z) by means of the formula below that can be used by adding up, element by element, the weight of the riser $P_{riser}$ and the weight of the mud $P_{mud}$, and by subtracting the buoyancy $\Delta_{archi}$.

$$N(z) = T_{top} - \sum_{top}^{z} (P_{riser} + P_{mud} - \Delta_{archi}) \tag{1}$$

In order to provide lateral stability of the riser, the effective tension has to be positive in all sections with a margin depending on the operating (water depth, fluid density and pressure, etc.) and environmental (wave motion, currents, etc.) conditions considered.

Another independent way of expressing this effective tension at depth point z consists in considering that it is equal to the sum of the tensions in the various components (solid and fluids) of the riser. If the riser were a simple tube, it would be the sum of the tension referred to as true tension in the wall (generating stresses and deformations in the metal) and of the (negative) tension in the fluid under pressure within (as a result of the mud pressure), decreased by the (also negative) tension exerted by the sea water (buoyancy). We then have:

$$N_{simple}(z)=T_{simple}(z)-P_i(z)\cdot S_i+P_e(z)\cdot S_e \tag{2}$$

where $N_{simple}$ is the tension in the wall of the tube, $P_i$ and $P_e$ the pressures prevailing inside and outside the tube, and $S_i$ and $S_e$ the inner and outer sections of the tube.

It can be shown that, in a section at the given depth point z, the effective tension in the riser is the sum of the effective tensions in its tubular components. We thus have:

$$N(z) = N_{TP}(z) + \sum_{LP} N_{LP}(z) \tag{3}$$

where $N_{TP}(z)$ and $N_{LP}(z)$ are the effective tensions in main tube (TP) and in auxiliary tubes (LP) made explicit by formula (2).

If one considers that no stress is normally transmitted from one line to the next (free sliding), one deduces therefrom that the tension exerted in the wall of the tube (negative) is only a function of the geometry and of the pressures. We have:

$$T_{LP}(z)=-P_i(z)\cdot(S_{seal}-S_i)+P_e(z)\cdot(S_{seal}-S_e) \tag{4}$$

and $$N_{LP}(z)=-[P_i(z)-P_e(z)]\cdot S_{seal}=-\Delta P(z)\cdot S_{seal} \tag{5}$$

The sealing section of the auxiliary lines is equal to the outer section $$S_{seal} = \frac{\pi}{4} D_{ext}^2$$

of the sliding end of male end part 25 in contact with seals 27, whose diameter bears reference $D_{ext}$.

The effective tension in a line is simply expressed as a function of the section of the seals $S_{seal}$ and of the pressure difference between the inside and the outside of the tube.

By replacing in Equation (3), we obtain:

$$N(z) = N_{TP}(z) - \sum_{LP} \Delta P \cdot S_{seal} \tag{6}$$

and by substituting in (1):

$$N_{TP}(z) = T_{top} - \sum_{top}^{z} (P_{riser} + P_{mud} - \Delta_{archi}) + \sum_{LP} \Delta P \cdot S_{seal} \tag{7}$$

and, again from Equation (2):

$$N_{TP}(z) = T_{top} - \sum_{top}^{z} (P_{riser} + P_{mud} - \Delta_{archi}) + \sum_{LP} \Delta P \cdot S_{seal} + (P_i \cdot S_i - P_e \cdot S_e) \tag{8}$$

This equation allows to realize that tension $T_{TP}$ exerted in the wall of main tube 4 of riser 1 (therefore the axial deformations and stresses in the main tube) is equal to the effective tension in the riser, to which adds further the effect of the pressures, commonly referred to as end load, in main tube 4 and in auxiliary lines 7. Since the pressure in auxiliary lines 7 can be very high, notably in the safety lines, the additional tension induced by this pressure should not be disregarded when dimensioning main tube 4.

According to the invention, it can be noted that the inner section of the seals of the auxiliary lines is directly involved in the calculation of many parameters that influence the dimensioning of riser 1, notably the following parameters:

the efforts, stresses and deformations in the wall of auxiliary lines 7, the conditions of buckling appearance for the tubes making up auxiliary lines 7, the efforts, stresses and deformations in main tube 4.

The present invention aims to optimize the dimensioning of a riser by reducing as much as possible the sealing section $S_{seal}$ of the auxiliary lines, in particular of the safety lines (kill lines and choke lines) that undergo the highest pressures. As a result of the impact of the sealing section on the stresses in auxiliary lines 7 and main tube 4, its reduction indeed allows to reduce globally and significantly the dimensions of the various elements of the riser.

The inside diameter of cylindrical male end part 25 bears reference $D_{int}$. The inside diameter of the auxiliary line is generally imposed by the riser users so as to limit the pressure drops in the line to acceptable values compatible with the blowout control procedures. Inside diameter $D_{int}$ of male end part 25 is usually taken equal to the inside diameter specified for the auxiliary line. Outside diameter $D_{ext}$ of end part 25 can thus be determined by calculating the stresses exerted on the end part under the effect of internal and external fluid pressure and by applying the API criterion according to which this stress must not exceed ⅔ of the elastic limit $Rp_{0.2}$ of the material used for manufacturing end part 25. Elastic limit $Rp_{0.2}$ is defined here as the stress that causes a permanent 0.2% residual deformation in the material.

Generally, the various elements making up the auxiliary lines, notably the safety lines such as the kill and choke lines, are made of a steel withstanding $H_2S$ corrosion, so as to meet for example the ISO-15156-2 standard, the international version of the NACE MR0175-91 standard. Unfortunately, high corrosion resistant steels generally have relatively low mechanical performances and, on the other hand, steels with a high elastic limit corrode rapidly in the presence of fluids laden with $H_2S$ and other acid gases contained in the effluents coming from oil wells. The various elements making up an auxiliary line 7 are therefore made of a steel exhibiting good corrosion resistance, but whose elastic limit is in practice limited to 552 MPa.

The present invention aims to manufacture male end part 25 with a material that is more resistant than the steel used for the other elements of riser 1, notably tubes 7 and/or connector 5 consisting of tubular male part 21, female part 20 and ring 22. For example, a metal whose elastic limit is at least 25%, or even 49% greater than the elastic limit of the steel of tubes 7 and/or connector 5 is selected. An excellent value for the elastic limit of the metal of end part 25 is at least 98% greater than the elastic limit of the steel of tubes 7 and/or of connector 5. In order to meet the corrosion resistance standards, a corrosion resistant material that can be screwed onto connection part 24 is selected.

End part 25 is for example made of titanium alloy. A titanium alloy Ti-6-4 (alloy comprising, in percent by weight, at least 85% titanium, about 6% aluminium and 4% vanadium) having an minimum elastic limit of 830 MPa can be used for example. Another titanium alloy used according to the invention is Ti-6-6-2 comprising, in percent by weight, about 6% aluminium, 6% vanadium, 2% tin and at least 80% titanium. Ti-6-6-2 has a minimum elastic limit of 965 MPa in the annealed state and even of 1100 MPa in the aged state.

End part 25 can also be made of a steel of high elastic limit. For example, it is possible to use steels X100 or X120 having an elastic limit of 690 MPa and 830 MPa respectively. In this case, in order to overcome the corrosion problem, the inner surface of end part 25, i.e. the tubular surface in contact with the fluid, is coated with an anti-corrosion protective layer. One of the techniques that can be used is cladding, using colamination or explosion. Such a coating can for example be made of a stainless steel. The coating can also be applied using techniques such as resurfacing by welding for example, or plasma powder spraying, then re-machining to the desired dimension.

Using a more resistant metal for end part 25 allows to reduce outside diameter $D_{ext}$ while keeping the specified inside diameter $D_{int}$. In fact, using a metal with a high elastic limit allows to reduce the thickness of tubular part 25 so as to withstand the internal and external pressures. The sealing sections can thus be reduced at the level of joints 27.

A method used for calculating the maximum stress in end part 25 consists in determining the three main stresses (longitudinal, circumferential and radial) for example for the element at the riser top (Pe=0) and in combining them according to the known von Mises formula:

$$\sigma_1 = -P_i \tag{9}$$

$$\sigma_2 = P_i \frac{D_{ext}^2 + D_{int}^2}{D_{ext}^2 - D_{int}^2} \text{(Lamé's thick-walled tube hypothesis)} \tag{10}$$

-continued $$\sigma_3 = -P_i \tag{11}$$

$$\sigma_{vM} = \sqrt{\frac{1}{2}[(\sigma_1 - \sigma_2)^2 + (\sigma_2 - \sigma_3)^2 + (\sigma_3 - \sigma_1)^2]} \tag{12}$$

$$\sigma_{vM} \leq \frac{2}{3} Rp_{0,2} \Rightarrow D_{ext}^2 \geq D_{int}^2 \frac{Rp_{O,2}}{Rp_{0,2} - 3P_i} \tag{13}$$

Other methods of dimensioning male end part 25 taking into account more general formulas for stress calculation, and/or involving linearization of the stresses in the wall thickness, and/or considering safety margins and manufacturing tolerances can be used. They all lead to similar results. Notably, they all highlight the fact that outside sealing diameter $D_{ext}$ is directly influenced by the elastic limit of the material $Rp_{0.2}$, which makes optimization thereof possible.

Modifying the nature of the metal that makes up end parts 25 by selecting a metal of higher elastic limit provides advantages for the whole of the riser. In fact, using a metal of high mechanical strength allows to reduce the sealing section $S_{seal}$ $$\left(S_{seal} = \frac{\pi}{4} D_{ext}^2\right).$$

This has the direct advantage of reducing the dimensions and therefore the weight of parts 25. However, this weight decrease is marginal for the whole of the riser and it alone does not justify the use of a noble and costly material for manufacturing parts 25. However, apart from this direct advantage, reducing the sealing section of end parts 25 has an impact on the entire riser dimensioning through the aforementioned equations and it allows, by reducing the efforts on the main tube and on the auxiliary lines, to reduce the dimensions and the weight of all the elements making up the riser. Thus, using a noble material for manufacturing a selected part of the riser allows to take advantage of the weight reduction for all of the elements of the riser.

Furthermore, according to the invention, in order to reduce the sealing section of end part 25, it is also possible to reduce inside diameter $D_{int}$ of end part 25. The inside diameter reduction allows outside sealing diameter $D_{ext}$ to be reduced while maintaining the wall thickness constant. Thus, each end part 25 forms a restriction of the inner passage in auxiliary line 7. This restriction causes an additional pressure drop in the auxiliary line, which can be compensated for by a slight increase in the inside diameter of tubes 7 in the intermediate sections.

The riser dimensioning examples presented below allow to compare and to illustrate the advantages of a riser provided with a titanium end part 25 according to the invention in relation to a conventional riser.

In Example No. 1, we consider a riser according to the prior art wherein the passage diameter inside the auxiliary lines is set at 4" (i.e. 101.6 mm) and the material of male end parts 25 is steel X80 having a minimum elastic limit of 552 MPa. Outside diameter $D_{ext}$ of end parts 25 is 5.88 inches, i.e. 149.4 mm. A riser was dimensioned on the basis of the following main engineering data:

water depth: 3000 m outside diameter of main tube 4: 533.4 mm (21")

operating pressure of auxiliary kill & choke lines 7: 1034 bar (15000 psi)

maximum drilling mud density: 1.8 (15 ppg)

steel of the main tube and of the safety lines: X80 with elastic limit 552 MPa.

By way of information, the main characteristics of the riser obtained are as follows:

wall thickness of auxiliary kill & choke lines 7: 24.2 mm thickness of the main tube wall: 22.5 mm diameter of the floats (according to an approximate calculation): 1454 mm total mass of the riser: 3511 t, decomposable into 1895 t steel and 1616 t syntactic foam (floats)

weight in water: 113 t maximum tension at the top: 710 t.

The approximate cost of such a riser is 40 M$, decomposable into 19 M$ steel and 21 M$ floats. These costs are estimated on the basis of an average price for the steel parts of 10 $/kg and an average price for the syntactic foam of 13 $/kg.

Examples No. 2 and No. 3 describe a reduction in outside sealing diameter $D_{ext}$ of end part 25.

In Example No. 2, the steel of end part 25 (and only of this part) is replaced by a titanium alloy with 6% aluminium and 4% vanadium (Ti-6-4), markedly more resistant. The minimum elastic limit of Ti-6-4 is in fact 830 MPa. Furthermore, this material is characterized by an excellent behaviour in the marine environment and in the presence of a fluid or a gas laden with $H_2S$ and $CO_2$.

In Example No. 3, in addition to the use of end part 25 made of titanium alloy, a ½ (12.7 mm) passage restriction is admitted inside end part 25, i.e. inside diameter $D_{int}$ is reduced to 88.9 mm (3.5").

The riser dimensioning results are shown in the table hereafter:

| Example | Inside diameter of end part 25 mm | Material of end part 25 mm | Thickness of end part 25 mm | Sealing diameter mm | Thickness of K&C lines 7 mm | Thickness of main tube 4 mm | Diameter of the floats mm |
|---|---|---|---|---|---|---|---|
| No. 1 | 101.6 | steel | 23.9 | 149.4 | 24.2 | 22.5 | 1454 |
| No. 2 | 101.6 | titanium | 11.3 | 124.2 | 21.5 | 20.5 | 1412 |
| No. 3 | 88.9 | titanium | 9.9 | 108.7 | 20.3 | 19.4 | 1389 |

and the overall characteristics of the riser are as follows:

| Case | Steel mass ton | Foam mass ton | Riser mass ton | Steel price M$ | Foam price M$ | Total price M$ | Price difference M$ |
|---|---|---|---|---|---|---|---|
| No. 1 | 1895 | 1616 | 3511 | 19 | 21 | 40 | — |
| No. 2 | 1760 | 1512 | 3272 | 17.6 | 19.7 | 37.3 | 2.7 |
| No. 3 | 1693 | 1457 | 3150 | 16.9 | 18.9 | 35.9 | 4.1 |

Thus, even if the above figures do not take into account the manufacturing overcost of end part 25 made of titanium, a costly material, the differences observed are quite significant:

the wall thickness reduction made possible by reducing the stresses induced by the internal pressure in the lines is directly the cause of the riser steel mass gains, with an identical float compensation, therefore with a similar dynamic behaviour of the disconnected riser, the diameter of the floats, and therefore their mass, is markedly reduced, the material weight gains amount to several hundred tons and million dollars. They do not take account of the savings induced by the riser mass reduction on the operations (logistics, handling, storage) that could be of the same order, the operating performances (operating envelopes) of the riser with an end part made of a high-resistance material according to the invention are as good as, or even better than those of the reference riser (improved dynamic behaviour, lesser current catch), the corrosion resistance of titanium alloys in aggressive environments (sea water, petroleum fluids, drilling muds) is reputedly excellent. The question of the galvanic coupling between the titanium end part and the steel of the auxiliary lines can be studied in order to avoid any risk of fast attack of the steel, an electrochemically less noble material.

The invention claimed is:

1. A method for producing a lightweight riser for offshore well drilling, the riser comprising a main tube extending up to a floating support, at least one auxiliary line being arranged parallel to the main tube, the at least one auxiliary line comprising tubular steel sections assembled end to end, each section of the tubular steel sections being connected to an adjacent section of the tubular steel sections by an end part, each end of the tubular steel sections being provided with a female connection, the end part being secured inside the female connection of the end of a section of the tubular steel sections and mounted with a sliding fit in the female connection of the end of another section of the tubular steel sections wherein the ends of the adjacent tubular steel sections are spaced apart by the end part, a seal being arranged between the end part and the section of the tubular steel sections at a level of the sliding fit, wherein the end part is selected to comprise a material having an elastic limit at least 25% higher than the elastic limit of the steel of the tubular steel sections, and the end part and the ends of the tubular steel sections are dimensioned by accounting for the elastic limit of the material so as to reduce an outer section of the end part at the level of the seal.

2. A method as claimed in claim 1, characterized in that an inside diameter of the end part is selected smaller than an inside diameter of the tubular steel sections of the at least one auxiliary line.

3. A method as claimed in claim 1, characterized in that a material having an elastic limit at least 49% higher than the elastic limit of the steel of the tubular steel sections is selected to manufacture the end part.

4. A riser obtained by the method as claimed in claim 1, characterized in that the material comprises a metal alloy comprising at least 80 wt. % titanium.

5. A riser as claimed in claim 4, characterized in that the material is a titanium alloy selected from the group consisting of Ti-6-4 and Ti-6-6-2.

6. A riser obtained by the method as claimed in claim 1, characterized in that the material comprises steel and in that at least an inner surface of the end part is coated with an anti-corrosion protective layer.

7. A riser as claimed in claim 1, characterized in that each one of said tubular sections comprises a metallic tubular body hooped by fiber windings coated with a polymer matrix.

8. A riser for offshore well drilling, the riser comprising: a main tube;

at least one auxiliary line arranged parallel to the main tube, the at least one auxiliary line comprising at least two tubular sections, each of the at least two tubular sections having two ends, the two ends comprising female connections;

an end part connecting adjacent tubular sections of the at least two tubular sections, the end part being secured inside a female connection of the female connections of one tubular section of the adjacent tubular sections, the end part being configured for mounting with a sliding fit in a female connection of the female connections of the other tubular section of the adjacent tubular sections wherein the ends of the adjacent tubular steel sections are spaced apart by the end part; and wherein the end part comprises a material having an elastic limit at least 2.5% higher than an elastic limit of the tubular sections, and an outside sealing diameter of the end part is dimensioned by accounting for the elastic limit of the material.

9. The riser as claimed in claim 8, wherein an inside diameter of the end part is smaller than an inside diameter of the adjacent tubular sections.

10. The riser as claimed in claim 8, wherein the at least two tubular sections are comprised of steel.

11. The riser as claimed in claim 10, wherein the end part comprises a material having an elastic limit at least 49% higher than the elastic limit of the steel of the at least two tubular sections.

12. The riser as claimed in claim 8, wherein the material is comprised of a metal alloy containing at least 80 wt. % titanium.

13. The riser as claimed in claim 12, wherein the material is comprised of titanium alloy selected from the group consisting of Ti-6-4 and Ti-6-6-2.

14. The riser as claimed in claim 8, wherein the material is comprised of steel and an inner surface of the end part is coated with an anti-corrosion protective layer.

15. A method as claimed in claim 1, wherein an inside diameter of the female connection is larger than an inside diameter of a main portion of the at least one auxiliary line.

16. The riser as claimed in claim 8, wherein inside diameters of the female connections are larger than an inside diameter of a main portion of the at least one auxiliary line.

* * * * *